US011906211B2

(12) United States Patent
Kester

(10) Patent No.: US 11,906,211 B2
(45) Date of Patent: Feb. 20, 2024

(54) HEATING, VENTILATION, AND AIR CONDITIONING SYSTEM WITH PRIMARY AND SECONDARY HEAT TRANSFER LOOPS

(71) Applicant: Johnson Controls Tyco IP Holdings LLP, Milwaukee, WI (US)

(72) Inventor: Douglas A. Kester, York, PA (US)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 247 days.

(21) Appl. No.: 17/412,008

(22) Filed: Aug. 25, 2021

(65) Prior Publication Data

US 2022/0042723 A1 Feb. 10, 2022

Related U.S. Application Data

(63) Continuation of application No. 15/890,120, filed on Feb. 6, 2018, now Pat. No. 11,105,539.
(Continued)

(51) Int. Cl.
*F25B 41/31* (2021.01)
*F25B 25/00* (2006.01)
(Continued)

(52) U.S. Cl.
CPC ..... *F25B 25/005* (2013.01); *F24D 1/00* (2013.01); *F25B 9/008* (2013.01); *F25B 49/005* (2013.01);
(Continued)

(58) Field of Classification Search
CPC ..... F25B 9/008; F25B 49/022; F25B 41/31
See application file for complete search history.

(56) References Cited

U.S. PATENT DOCUMENTS 10,082,078 B2 9/2018 Snape et al.
2002/0007943 A1 1/2002 Ozaki et al.
(Continued)

FOREIGN PATENT DOCUMENTS

EP 1046869 B1 2/2005
EP 2937649 A1 10/2015
EP 3172290 A1 5/2017

*Primary Examiner* — Nael N Babaa
(74) *Attorney, Agent, or Firm* — Fletcher Yoder P.C.

(57) ABSTRACT

The present disclosure relates to a heating ventilation and air conditioning (HVAC) system. The system includes a primary heat transfer loop configured to be disposed at least partially outside of a building, and the primary heat transfer loop includes a heat exchanger, a compressor configured to compress a refrigerant, where the refrigerant is reactive, a condenser configured to receive and condense the refrigerant, and an expansion device configured to reduce a temperature of the refrigerant. The system further includes a secondary heat transfer loop configured to circulate a two-phase fluid at least partially inside the building, wherein the two-phase fluid is less reactive than the refrigerant. The secondary heat transfer loop includes the heat exchanger, where the heat exchanger is configured to transfer energy from the two-phase fluid circulating in the secondary heat transfer loop to the refrigerant, and an evaporator configured to evaporate the two-phase fluid by exchanging energy with an air supply stream flowing across the evaporator.

20 Claims, 6 Drawing Sheets

Related U.S. Application Data

(60) Provisional application No. 62/593,317, filed on Dec. 1, 2017.

(51) Int. Cl.

| | |
|---|---|
| ***F25B 9/00*** | (2006.01) |
| ***F25B 49/02*** | (2006.01) |
| ***F24D 1/00*** | (2022.01) |
| ***F25B 49/00*** | (2006.01) |
| *F25B 7/00* | (2006.01) |

(52) U.S. Cl.

CPC ..... *F25B 49/022* (2013.01); *F25B 7/00* (2013.01); *F25B 41/31* (2021.01); *F25B 2309/06* (2013.01); *F25B 2327/00* (2013.01); *F25B 2400/054* (2013.01); *F25B 2600/0271* (2013.01)

(56) References Cited

U.S. PATENT DOCUMENTS

| | | | | |
|---|---|---|---|---|
| 2004/0210419 | A1 | 10/2004 | Wiebe et al. | |
| 2007/0056312 | A1 | 3/2007 | Kobayashi | |
| 2009/0120117 | A1 | 5/2009 | Martin et al. | |
| 2009/0171512 | A1 | 7/2009 | Duncan | |
| 2010/0287978 | A1 | 11/2010 | Moreland | |
| 2012/0117996 | A1 | 5/2012 | Hinde et al. | |
| 2013/0061612 | A1 | 3/2013 | Shiflett et al. | |
| 2013/0121454 | A1 | 5/2013 | Newton et al. | |
| 2013/0205824 | A1 | 8/2013 | Morimoto et al. | |
| 2015/0204595 | A1* | 7/2015 | Sunderland ..... | F25B 25/005 165/295 |
| 2015/0330674 | A1 | 11/2015 | Yamashita | |
| 2017/0067671 | A1 | 3/2017 | Evans et al. | |
| 2017/0191712 | A1 | 7/2017 | Feng et al. | |

* cited by examiner

HEATING, VENTILATION, AND AIR CONDITIONING SYSTEM WITH PRIMARY AND SECONDARY HEAT TRANSFER LOOPS

CROSS REFERENCE TO RELATED APPLICATIONS

This is a continuation application of U.S. patent application Ser. No. 15/890,120, entitled "HEATING, VENTILATION, AND AIR CONDITIONING SYSTEM WITH PRIMARY AND SECONDARY HEAT TRANSFER LOOPS," filed Feb. 6, 2018, which claims priority from and the benefit of U.S. Provisional Application Ser. No. 62/593,317, entitled "HEATING, VENTILATION, AND AIR CONDITIONING SYSTEM WITH PRIMARY AND SECONDARY HEAT TRANSFER LOOPS," filed Dec. 1, 2017, each of which is hereby incorporated by reference in its entirety for all purposes.

BACKGROUND

The disclosure relates generally to HVAC systems.

Heating, ventilation, and air conditioning (HVAC) systems cool enclosed spaces by exchanging energy between a refrigerant and air. HVAC systems do this by circulating a refrigerant between two heat exchangers commonly referred to as an evaporator coil and a condenser coil. As refrigerant passes through the evaporator coil and the condenser coil, the refrigerant either absorbs or discharges thermal energy. More specifically, as air passes over the evaporator coil, the air cools as it loses energy to the refrigerant passing through the evaporator coil. In contrast, the condenser enables the refrigerant to discharge heat into the atmosphere. Inasmuch as refrigerant leaks occur, it is undesirable to have refrigerant leaks within an enclosed space, such as a home.

SUMMARY

The present disclosure relates to a heating ventilation and air conditioning (HVAC) system. The system includes a primary heat transfer loop configured to be disposed at least partially outside of a building, and the primary heat transfer loop includes a heat exchanger, a compressor configured to compress a refrigerant, where the refrigerant is reactive, a condenser configured to receive and condense the refrigerant, and an expansion device configured to reduce a temperature of the refrigerant. The system further includes a secondary heat transfer loop configured to circulate a two-phase fluid at least partially inside the building, wherein the two-phase fluid is less reactive than the refrigerant. The secondary heat transfer loop includes the heat exchanger, where the heat exchanger is configured to transfer energy from the two-phase fluid circulating in the secondary heat transfer loop to the refrigerant, and an evaporator configured to evaporate the two-phase fluid by exchanging energy with an air supply stream flowing across the evaporator.

The present disclosure also relates to a heating ventilation and air conditioning (HVAC) system. The system includes a primary heat transfer loop configured to be disposed outside of a building, where the primary heat transfer loop includes a heat exchanger, a compressor configured to compress a refrigerant, where the refrigerant is reactive, a condenser configured to receive and condense the refrigerant, and an expansion device configured to reduce a temperature of the refrigerant. The system further includes a secondary heat transfer loop configured to direct a two-phase fluid inside the building, where the two-phase fluid is inert. The secondary heat transfer loop includes a heat pipe configured to carry the two-phase fluid, where the two-phase fluid is configured to absorb energy from a supply airstream, and the heat exchanger, where the heat exchanger is configured to exchange energy between the refrigerant circulating in the primary heat transfer loop and the two-phase fluid in the heat pipe.

The present disclosure further relates to a heating ventilation and air conditioning (HVAC) system having a primary heat transfer loop and a secondary heat transfer loop. The primary heat transfer loop is configured to be disposed outside of a building and includes a compressor configured to compress a refrigerant, where the refrigerant is reactive, a condenser configured to receive and condense the refrigerant, and an expansion device configured to reduce a temperature of the refrigerant. The secondary heat transfer loop is configured to circulate a two-phase fluid inside the building, where the two-phase fluid is inert. The secondary heat transfer loop includes a heat exchanger configured to transfer energy from the two-phase fluid circulating in the secondary heat transfer loop to the refrigerant and an evaporator configured to evaporate the two-phase fluid by exchanging energy with an air supply stream flowing over the evaporator. The system further includes a first sensor configured to emit a first signal indicative of a first pressure of the refrigerant, a second sensor configured to emit a second signal indicative of a second pressure of the two-phase fluid, and a controller configured to receive the first signal and the second signal.

DRAWINGS

DETAILED DESCRIPTION

Embodiments of the present disclosure include a split HVAC system with primary and secondary heat transfer loops that enable indirect cooling of a supply airstream with a refrigerant. More specifically, the split HVAC system uses a refrigerant in a primary heat transfer loop located outside an enclosed space. For example, the enclosed space may be a house, an apartment, an office building. The refrigerant circulating in the primary heat transfer loop cools a two-phase fluid in a secondary heat transfer loop that then circulates within the enclosed space to cool a supply airstream. In this way, the split HVAC system is able to use an eco-friendly refrigerant to cool the enclosed space while blocking or reducing circulation of that refrigerant within the enclosed space.

Figure 1:
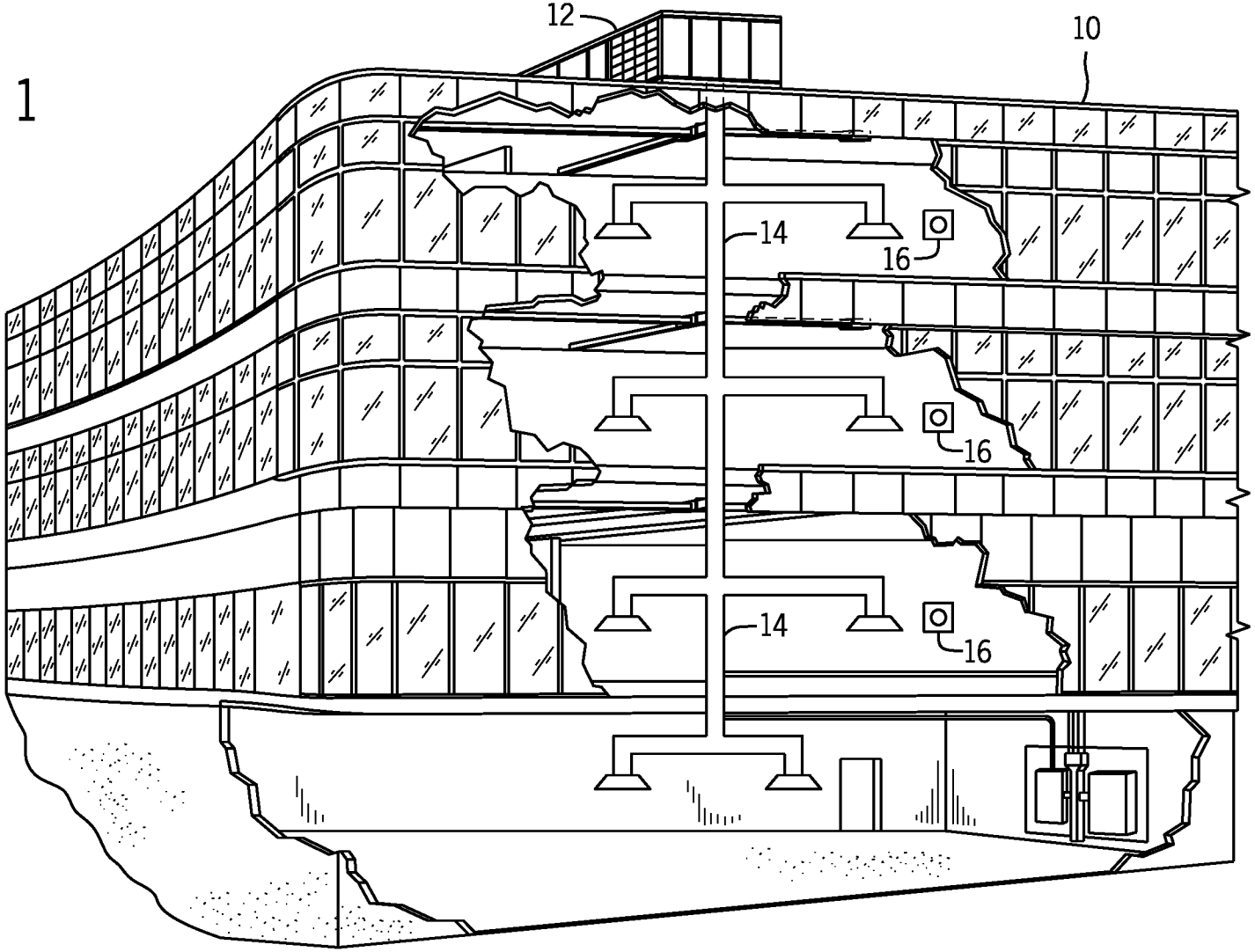
FIG. 1 is a perspective view of an embodiment of a building that may utilize a heating, ventilation, and air conditioning (HVAC) system in a commercial setting, in accordance with an aspect of the present disclosure.

Turning now to the drawings, FIG. 1 illustrates a heating, ventilating, and air conditioning (HVAC) system for building environmental management that may employ one or more HVAC units. In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air-cooled device that implements a refrigeration cycle to provide conditioned air to the building 10. Specifically, the HVAC unit 12 may include one or more heat exchangers across which an airflow is passed to condition the airflow before the airflow is supplied to the building. In the illustrated embodiment, the HVAC unit 12 is a rooftop unit (RTU) that conditions a supply airstream, such as environmental air and/or a return airflow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an airstream and a furnace for heating the airstream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
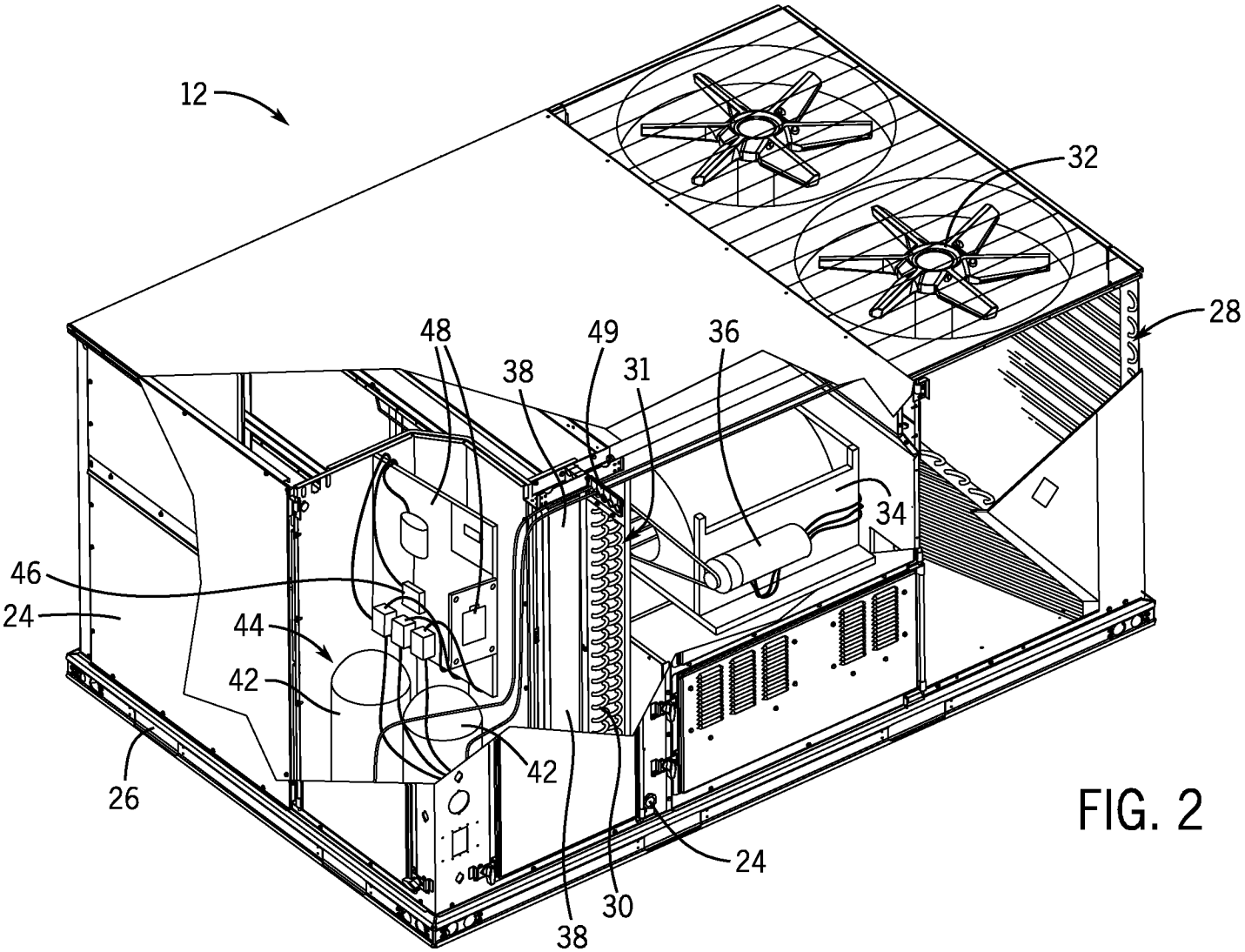
FIG. 2 is a perspective view of an embodiment of an HVAC unit of the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an airstream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant through the heat exchangers 28 and 30. For example, the refrigerant may be R-410A. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an airstream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the airstream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned airflows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive him arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
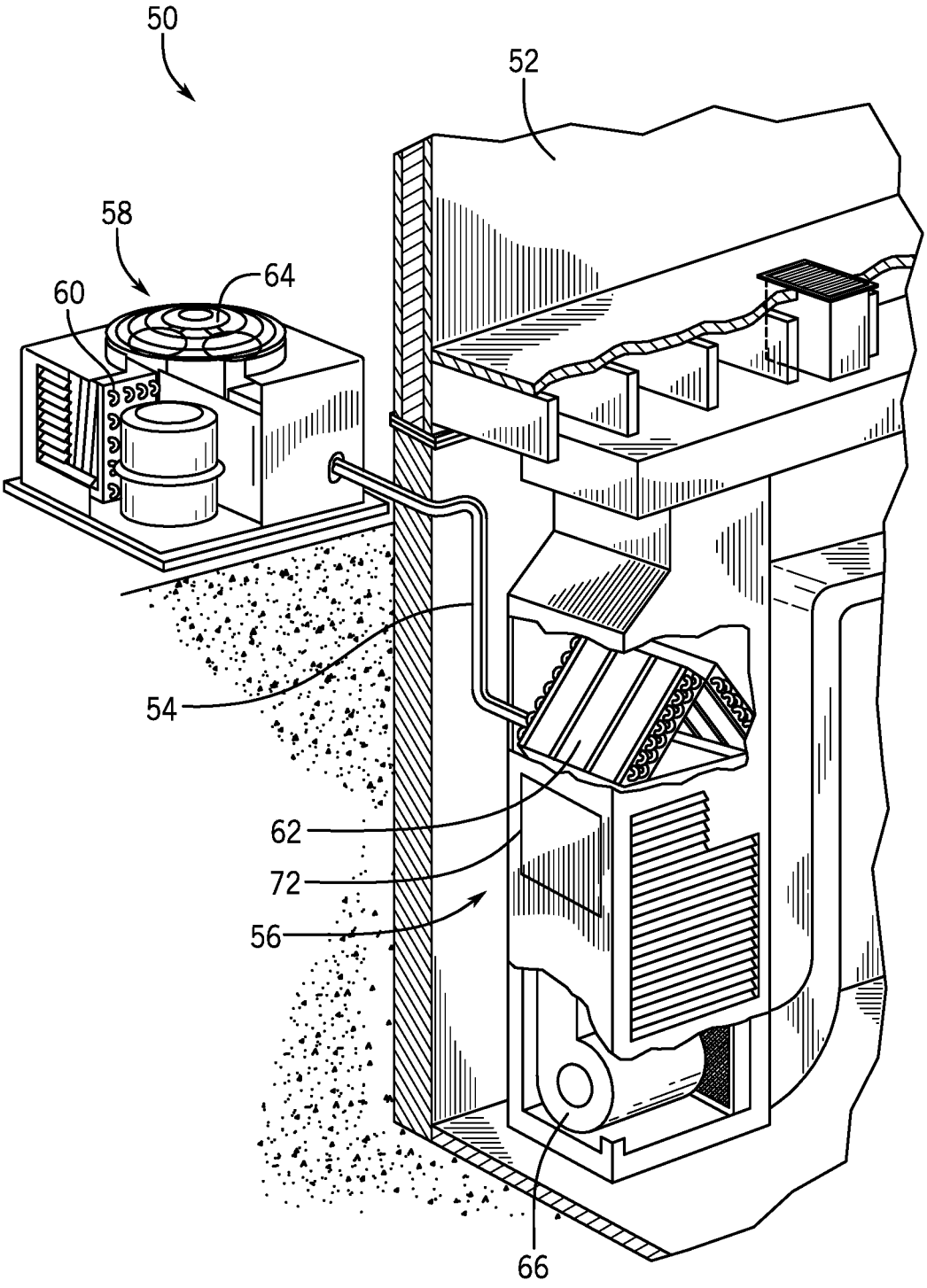
FIG. 3 is a perspective view of an embodiment of a residential, split HVAC system that includes an indoor HVAC unit and an outdoor HVAC unit, in accordance with an aspect of the present disclosure.

FIG. 3 illustrates a residential heating and cooling system 50, in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 72. For example, the indoor unit 56 may include the furnace system 72 when the residential heating and cooling system 50 is not configured to operate as a heat pump. The furnace system 72 may include a burner assembly and heat exchanger, among other components, inside the indoor unit 56. Fuel is provided to the burner assembly of the furnace 72 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 72 to the ductwork for heating the residence 52.

Figure 4:
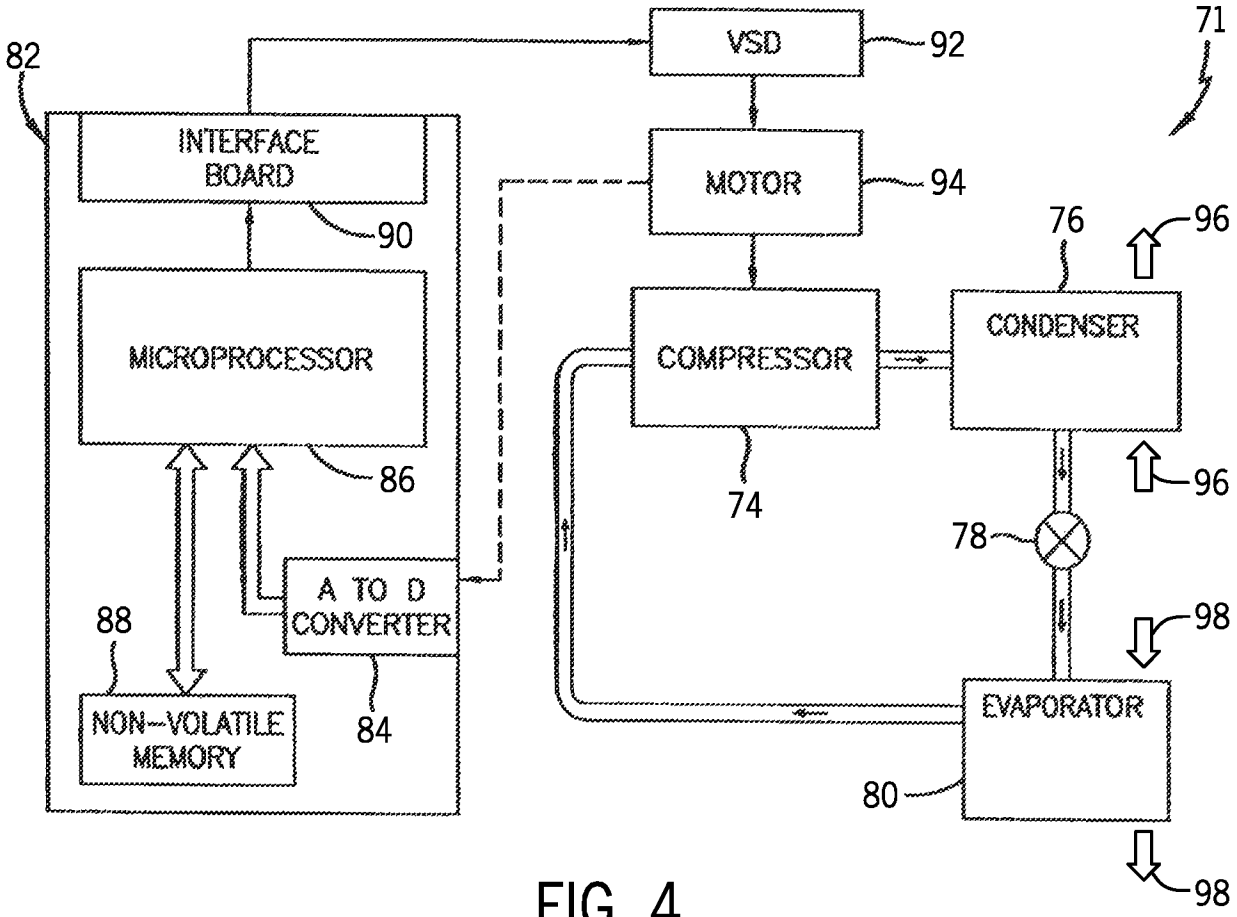
FIG. 4 is a schematic of an embodiment of an HVAC system, in accordance with an aspect of the present disclosure.

FIG. 4 is an embodiment of a vapor compression system 71 that can be used in any of the systems described above. The vapor compression system 71 may circulate a refrigerant through a circuit starting with a compressor 74. The circuit may also include a condenser 76, an expansion valve(s) or device(s) 78, and an evaporator 80. The vapor compression system 71 may further include a control panel 82 that has an analog to digital (A/D) converter 84, a microprocessor 86, a non-volatile memory 88, and/or an interface board 90. The control panel 82 and its components may function to regulate operation of the vapor compression system 71 based on feedback from an operator, from sensors of the vapor compression system 71 that detect operating conditions, and so forth.

In some embodiments, the vapor compression system 71 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another airstream, such as a supply airstream 98 provided to the building 10 or the residence 52. For example, the supply airstream 98 may include ambient or environmental air, return air from a building, or a combination of the two. The liquid refrigerant in the evaporator 80 may undergo a phase change from the liquid refrigerant to a refrigerant vapor. In this manner, the evaporator 38 may reduce the temperature of the supply airstream 98 via thermal heat transfer with the refrigerant. Thereafter, the vapor refrigerant exits the evaporator 80 and returns to the compressor 74 by a suction line to complete the cycle.

In some embodiments, the vapor compression system 71 may further include a reheat coil in addition to the evaporator 80. For example, the reheat coil may be positioned downstream of the evaporator relative to the supply airstream 98 and may reheat the supply airstream 98 when the supply airstream 98 is overcooled to remove humidity from the supply airstream 98 before the supply airstream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply airstream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Figure 5:
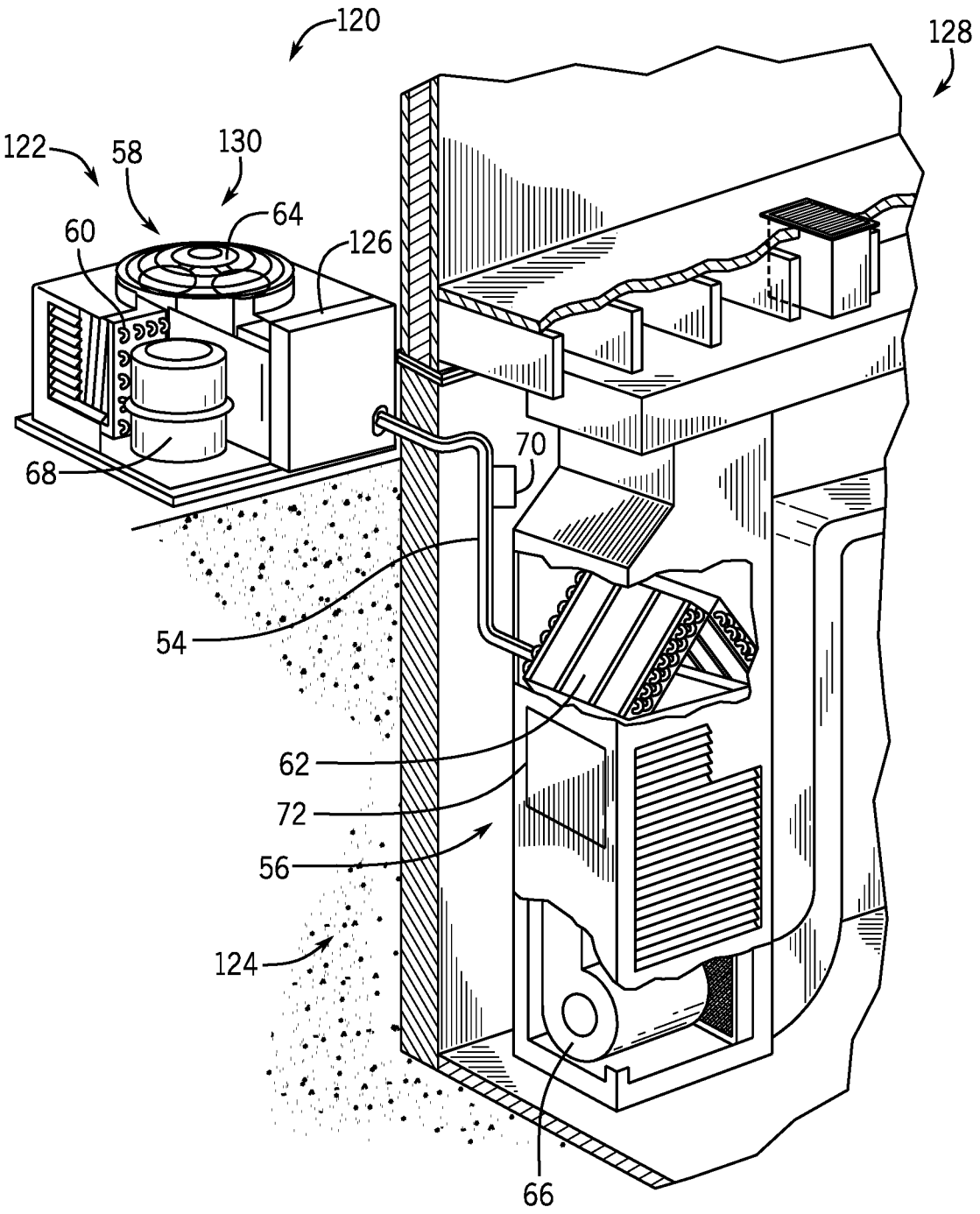
FIG. 5 is a perspective view of an embodiment of a split HVAC system with primary and secondary heat transfer loops, in accordance with an aspect of the present disclosure.

FIG. 5 is a schematic view of an embodiment of a split HVAC system 120 that uses a refrigerant. In certain embodiments, the refrigerant may be reactive. The refrigerant being classified as numerically equal to or greater than the refrigerants A2L or B2L according to the ISO 817 refrigerant classification scheme. For example, the refrigerant may be an A2L, B2L, A2, B2, A3, or B3 refrigerant accordingly to the ISO 817 refrigerant classification scheme. The split HVAC system 120 includes primary and secondary heat transfer loops 122, 124 that circulate different cooling fluids. More specifically, the primary heat transfer loop 122 circulates a refrigerant through the outdoor unit 58, while the secondary heat transfer loop 124 circulates a two-phase fluid through the indoor unit 58. The refrigerant may be reactive, and the two-phase fluid may be less reactive than the refrigerant or may be inert. The first and second heat transfer loops 122, 124 couple to each other with a heat exchanger 126, which enables energy transfer between the refrigerant and the two-phase fluid without direct contact between the two. In this way, the split HVAC system 120 is able to use a desired refrigerant to indirectly cool the enclosed space 128 while simultaneously blocking or reducing circulation of the refrigerant through the enclosed space 128. For example, the enclosed space 128 may be a home, apartment, office building. In other words, by using the primary and secondary heat transfer loops 122, 124, the split HVAC system 120 enables cooling of the enclosed space 128 with the refrigerant while blocking and/or reducing possible combustion of the refrigerant within the enclosed space 128.

As illustrated, the primary and secondary heat transfer loops 122, 124 couple to the heat exchanger 126 in order to exchange energy. The secondary heat transfer loop 124 couples to the heat exchanger 126 using conduits 54 while the primary heat transfer loop 122 couples to the heat exchanger 126 with conduits 130. In operation, the conduits 54 circulate a two-phase fluid between the indoor unit 56 and the heat exchanger 126. As the two-phase fluid circulates, it absorbs energy in the indoor unit 56 and discharges energy in the heat exchanger 126. In contrast, the primary heat transfer loop 122 circulates the refrigerant between the outdoor unit 58 and the heat exchanger 126. As the refrigerant circulates, it absorbs energy from the two-phase fluid in the heat exchanger 126 and discharges energy into the atmosphere.

The outdoor unit 58 enables the refrigerant to discharge energy to the atmosphere using a condenser 60. The condenser 60 facilitates heat transfer from the refrigerant to the surrounding air by increasing the surface area available for heat transfer. The outdoor unit 58 may also include a fan 64 that draws or blows air over the condenser 60 to facilitate the transfer of energy. As the refrigerant discharges energy to the atmosphere, the refrigerant changes states from a vapor to a liquid. After passing through the condenser 60, the refrigerant is pumped by the compressor 68 back into the heat exchanger 126 where it evaporates as it again absorbs energy from the two-phase fluid circulating in the secondary heat transfer loop 124.

The secondary heat transfer loop 124 experiences a similar heat transfer cycle as the two-phase fluid absorbs energy and then later discharges it. As illustrated, the indoor unit 56 includes an evaporator 62 that receives the two-phase fluid. As the two-phase fluid passes through the evaporator 62, the two-phase fluid absorbs energy from a supply airstream flowing over the evaporator 62. The air may be blown over the evaporator 62 with the blower 66. As the two-phase fluid absorbs energy from the supply airstream it evaporates, or in other words changes states from a liquid to a vapor. After passing through the evaporator 62, the two-phase fluid is recirculated to the heat exchanger 126. In the heat exchanger 126, the two-phase fluid rejects heat to the refrigerant and condenses from a vapor back into a liquid. The heat transfer cycle then begins again as the two-phase fluid is pumped by a pump 70 back to the evaporator 62. As the two-phase fluid absorbs energy in the evaporator 62, the supply airstream cools and then carried through ductwork to various areas of the enclosed space 128.

In some embodiments, the indoor unit 56 may include the furnace system 72. The furnace system 72 may include a burner assembly and heat exchanger, among other components. In some embodiments, the furnace system 72 combusts a fuel to generate heat, such as natural gas. The combustion products may pass through tubes or piping in a heat exchanger, separate from heat exchanger 62, such that air directed by the blower 66 passing over the tubes or pipes absorbs heat from the combustion products. The heated air may then be routed from the furnace system 72 to the ductwork for heating the enclosed space 128. In some embodiments, the furnace 72 may not combust a fuel, but may instead use electrical energy to heat air blown by the blower 66. Regardless of how the furnace system 72 heats the air, by blocking circulation of the refrigerant through the indoor unit 56, the split HVAC system 120 is able to reduce and/or block combustion of the refrigerant by the furnace system 72 using the primary and secondary heat transfer loops 122, 124.

Figure 6:
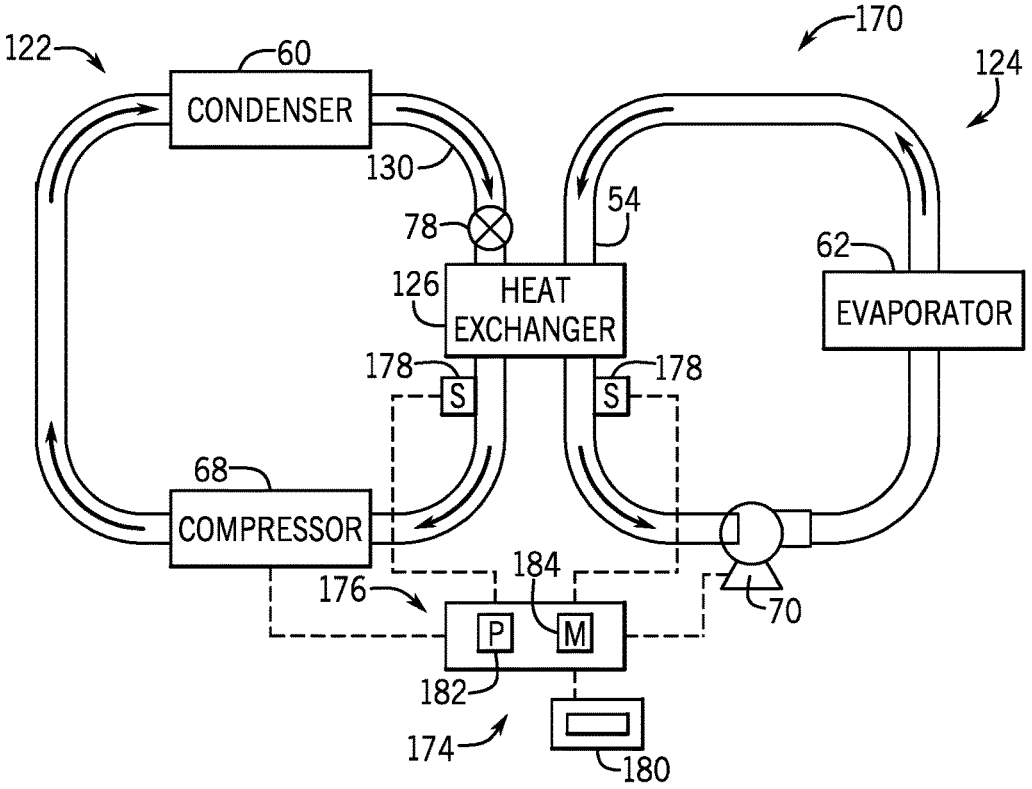
FIG. 6 is a schematic view of an embodiment of a split HVAC system with primary and secondary heat transfer loops, in accordance with an aspect of the present disclosure.

FIG. 6 is a schematic view of a split HVAC system 170 with primary and secondary heat transfer loops 122, 124. As explained above, the split HVAC system 170 circulates a refrigerant in the primary heat transfer loop 122, which is located outside of an enclosed space 128 and a two-phase fluid in the secondary heat transfer loop 124 located within the enclosed space 128. The two fluids exchange energy using the heat exchanger 126 with the refrigerant absorbing energy from the two-phase fluid. In this way, the split HVAC system 170 is able to use refrigerant to cool an enclosed space 128 without circulating the refrigerant through the enclosed space 128.

The primary heat transfer loop 122 begins with the compressor 68. The compressor 68 drives circulation of the refrigerant through the primary heat transfer loop 122 by compressing and pumping the refrigerant. As the compressor 68 compresses the refrigerant vapor, the compressor 68 delivers the refrigerant to the condenser 60. In some embodiments, the compressor 68 may be a centrifugal compressor. As the refrigerant passes through the condenser 60, it releases energy to air surrounding and/or flowing over the condenser 60. The release of energy condenses the refrigerant vapor into a liquid refrigerant. The liquid refrigerant then flows through an expansion device 78, which drops the pressure and reduces the temperature of the refrigerant. The refrigerant then enters the heat exchanger 126. In the heat exchanger 126, the refrigerant absorbs energy from the two-phase fluid circulating in the secondary heat transfer loop 124. As the refrigerant absorbs energy, it changes states from a liquid to a vapor. The refrigerant vapor then reenters the compressor 68 restarting the cycle.

As explained above, the primary and secondary heat transfer loops 122, 124 couple together with the heat exchanger 126. More specifically, the heat exchanger 126 enables heat transfer between the two-phase fluid circulating through the secondary heat transfer loop 124 and the refrigerant circulating through the primary heat transfer loop 122. As the two-phase fluid loses energy to the refrigerant, the two-phase fluid condenses from a gas to a liquid. The liquid form of the two-phase fluid is then pumped from the heat exchanger 126 to the evaporator 62 with the pump 70. The evaporator 62 enables the two-phase fluid to exchange energy with a supply airstream. The supply airstream may include ambient or environmental air, return air from a building, or a combination of the two. As the supply airstream flows over the evaporator 62, the two-phase fluid phase changes from a liquid to a gas as it absorbs energy from the supply airstream. The two-phase fluid is then recirculated to the heat exchanger 126 where it again exchanges energy with the refrigerant. In this way, the split HVAC system 170 enables the refrigerant to indirectly cool the supply airstream while blocking and/or reducing circulation of the refrigerant in a home, apartment, office building.

In some embodiments, the two-phase fluid circulated in the secondary heat transfer loop 124 is carbon dioxide. The use of carbon dioxide as the two-phase fluid enables the split HVAC system 170 to remove carbon dioxide from the surroundings. Moreover, in the event that the secondary heat transfer loop 124 leaks, the split HVAC system 170 does not increase the overall carbon dioxide in the surroundings. In other words, because the split HVAC system 170 was originally charged with carbon dioxide from the atmosphere, a leak will therefore not increase overall carbon emissions. The use of carbon dioxide in the secondary heat transfer loop 124 may also enable the secondary heat transfer loop 124 to operate at a pressure greater than the primary heat transfer loop 122. A difference in pressure between the primary and secondary heat transfer loops 122, 124 may block and/or reduce the circulation of the refrigerant in the secondary heat transfer loop 124. For example, if a leak occurs in the heat exchanger 126 the higher pressure of the two-phase fluid in the secondary heat transfer loop 124 blocks the refrigerant in the primary heat transfer loop 122 from entering the secondary heat transfer loop 124, and thus circulation of the refrigerant through a home, apartment, office building.

In some embodiments, the split HVAC system 170 may include a pressure monitoring system 174 that monitors the pressure of the refrigerant in the primary heat transfer loop 122 and the pressure of the two-phase fluid in the secondary heat transfer loop 124. By monitoring these pressures, the pressure monitoring system 174 is able to detect when refrigerant is able to leak from the primary heat transfer loop 122 into the secondary heat transfer loop 124. In other words, if the pressure of the two-phase fluid in the secondary transfer loop 124 drops below the pressure of the refrigerant in the primary heat transfer loop 122, then refrigerant could enter the secondary heat transfer loop 124 if a leak exists in the heat exchanger 126.

The pressure monitoring system 174 includes a controller 176 and pressure sensors 178. In operation, the pressure sensors 178 emit a signal indicative of the pressures in the primary and secondary heat transfer loops 122, 124. The sensors 178 may be positioned at various locations on the primary and secondary heat transfer loops 122, 124 including upstream and/or downstream of the heat exchanger 126 as well as in the heat exchanger 126. In some embodiments, the pressure monitoring system 174 may include multiple pressure sensors 178 on both the primary and secondary heat transfer loops 122, 124 that are upstream from, downstream from, and/or within the heat exchanger 126. By including multiple pressure sensors 178 on each heat transfer loop, the pressure monitoring system 174 may provide redundant monitoring as well as cross-referencing of the pressures.

As the controller 176 receives these signals, it processes them to determine the pressures within the primary and secondary heat transfer loops 122, 124. The controller 176 then compares the pressures in the primary and secondary heat transfer loops 122, 124 to determine if the pressure of the two-phase fluid is greater than the pressure of the refrigerant. If it is, the controller 176 continues to monitor the split HVAC system 170. If not, the controller 176 may shutdown the pump 70 and/or the compressor 68 to limit and/or block the possible flow of refrigerant into the secondary heat transfer loop 124, and thus into a home, apartment, office building.

In some embodiments, the controller 176 may communicate through wireless and/or wired networks with an electronic device 180. That is, the controller 176 may provide updates and/or receive input from a user through the electronic device 180. The electronic device 180 may be a cell phone, laptop, smart thermostat, tablet, watch. For example, the controller 176 may transmit a warning to an electronic device 180 that the pressure of the two-phase fluid in the secondary heat transfer loop 124 is less than the pressure of the refrigerant and thus susceptible to refrigerant leaking into the secondary heat transfer loop 124. The warning may be provided in a variety of ways including as a written message on a display of the electronic device 180, an audio message, a warning sound, flashing lights, or combinations thereof. For example, the controller 176 may request confirmation to shut down the compressor 68 and/or the pump 70. In some embodiments, the controller 128 may request feedback from the user through the electronic device 152. The request may include confirmation to shut down the compressor 68 and/or the pump 70.

The controller 176 may include a processor 182 and a memory 184 used in processing one or more signals from one or more sensors 178. For example, the processor 182 may be a microprocessor that executes software to control the Split HVAC system 170. For example, the processor 182 may controls operation of the compressor 68 and/or pump 70. The processor 182 may include multiple microprocessors, one or more "general-purpose" microprocessors, one or more special-purpose microprocessors, and/or one or more application specific integrated circuits (ASICS), or some combination thereof. For example, the processor 182 may include one or more reduced instruction set (RISC) processors.

The memory 184 may include a volatile memory, such as random access memory (RAM), and/or a nonvolatile memory, such as read-only memory (ROM). The memory 184 may store a variety of information and may be used for various purposes. For example, the memory 184 may store processor executable instructions, such as firmware or software, for the processor 182 to execute. The memory may include ROM, flash memory, a hard drive, or any other suitable optical, magnetic, or solid-state storage medium, or a combination thereof. The memory may store data, instructions, such as software or firmware for controlling the split HVAC system 170, and any other suitable data.

Figure 7:
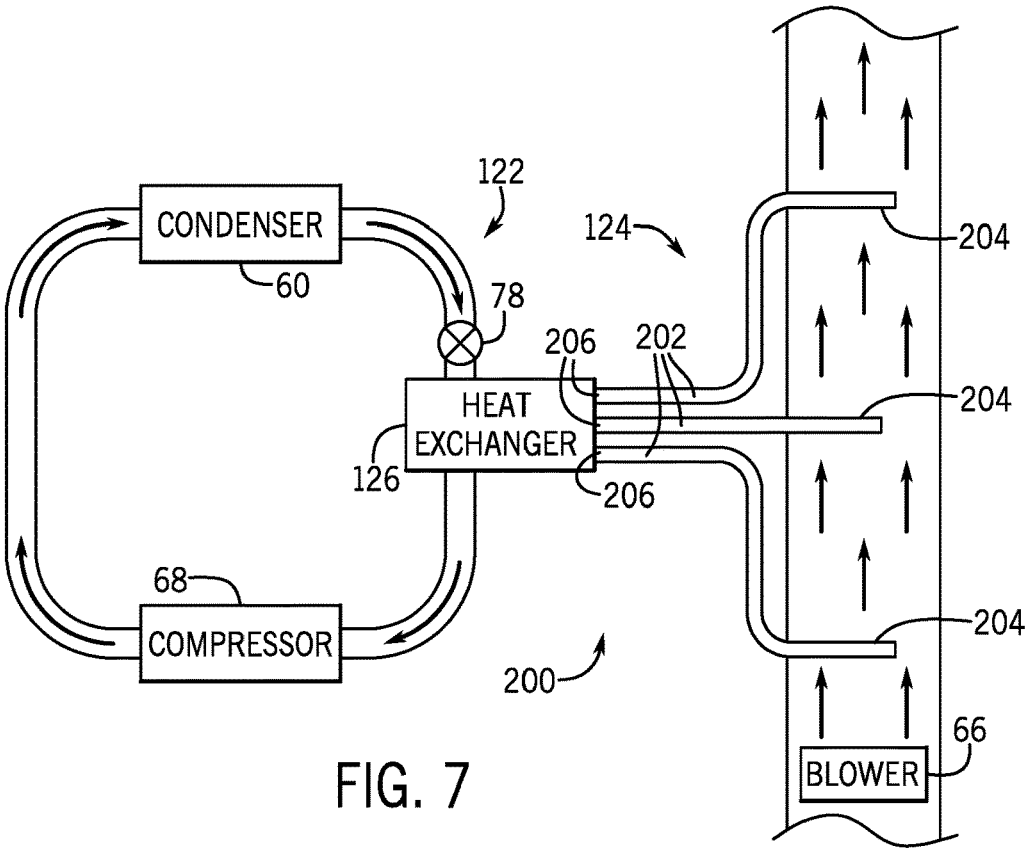
FIG. 7 is a schematic view of an embodiment of a split HVAC system with primary and secondary heat transfer loops, in accordance with an aspect of the present disclosure.

FIG. 7 is a schematic view of an embodiment of a split HVAC system 200 with primary and secondary heat transfer loops 122, 124. As explained above, the split HVAC system 200 circulates a refrigerant in the primary heat transfer loop 122, which is located outside of an enclosed space 128 and a two-phase fluid in the secondary heat transfer loop 124 located within the enclosed space 128. The two fluids exchange energy using the heat exchanger 126 with the refrigerant absorbing energy from the two-phase fluid. In this way, the split HVAC system 200 is able to use refrigerant to indirectly cool an enclosed space 128 without circulating the refrigerant through the enclosed space 128.

The primary heat transfer loop 122 begins with the compressor 68. The compressor 68 drives circulation of the refrigerant through the primary heat transfer loop 122 by compressing and pumping the refrigerant. As the compressor 68 compresses the refrigerant vapor, the compressor 68 delivers the refrigerant to the condenser 60. In some embodiments, the compressor 68 may be a centrifugal compressor. As the refrigerant passes through the condenser 60, it releases energy to air surrounding and/or flowing over the condenser 60. The release of energy condenses the refrigerant vapor into a liquid refrigerant. The liquid refrigerant then flows through an expansion device 78, which drops the pressure and reduces the temperature of the refrigerant. The refrigerant then enters the heat exchanger 126. In the heat exchanger 126, the refrigerant absorbs energy from the two-phase fluid circulating in the secondary heat transfer loop 124. As the refrigerant absorbs energy, it changes states from a liquid to a vapor. The refrigerant vapor then reenters the compressor 68 restarting the cycle.

As explained above, the primary and secondary heat transfer loops 122, 124 couple together with the heat exchanger 126. More specifically, heat exchanger 126 enables heat transfer between the two-phase fluid circulating through the secondary heat transfer loop 124 and the refrigerant circulating through the primary heat transfer loop 122. As the two-phase fluid loses energy to the refrigerant, the two-phase fluid condenses from a gas to a liquid. However, instead of pumping the two-phase fluid through the secondary heat transfer loop 124, the secondary heat transfer loop 124 includes one or more heat pipes 202 that circulate the two-phase fluid between first and second ends 204, 206 without mechanical assistance.

In operation, the refrigerant removes energy from the two-phase fluid in the heat pipe 202 enabling the two-phase fluid to condense. The liquid two-phase fluid is then wicked to the first end 204 of the heat pipes 202. As illustrated, the first ends 204 of the heat pipes 202 rest within a supply airstream 208. The supply airstream 208 may include ambient or environmental air, return air from a building, or a combination of the two. As the supply airstream 208 flows over the first ends 204, the two-phase fluid undergoes a phase change as it absorbs energy that is changes from a liquid into a gas. This reduces the temperature of the supply airstream via thermal heat transfer with the two-phase fluid. The gaseous phase of the two-phase fluid then flows back to the second end 206 of the heat pipe 202 where it again exchanges energy with the refrigerant. After changing phases again, the liquid two-phase fluid is wicked from the second end 206 to the first end 204 of the heat pipes 202, thus restarting the heat transfer cycle. By using the heat pipes 202, the split HVAC system 200 enables the refrigerant to indirectly cool the supply airstream 208 while blocking and/or reducing circulation of the refrigerant in a home, apartment, office building.

Only certain features and embodiments of the disclosure have been illustrated and described, many modifications and changes may occur to those skilled in the art without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed subject matter. It should be appreciated that in the development of any such actual implementation, as in any engineering or design project, numerous implementation specific decisions may be made. Such a development effort might be complex and time consuming, but would be a routine undertaking of design, fabrication, and manufacture for those of ordinary skill having the benefit of this disclosure, without undue experimentation.

The invention claimed is:

1. A heating, ventilation, and air conditioning (HVAC) system, comprising:

a primary heat transfer loop, comprising:

a heat exchanger; and a compressor configured to direct a first heat transfer fluid along the primary heat transfer loop and through the heat exchanger at a first operating pressure;

a secondary heat transfer loop, comprising:

the heat exchanger; and a pump configured to direct a second heat transfer fluid along the secondary heat transfer loop and through the heat exchanger at a second operating pressure higher than the first operating pressure; and a controller configured to receive feedback indicative of a first pressure of the first heat transfer fluid in the primary heat transfer loop, receive additional feedback indicative of a second pressure of the second heat transfer fluid in the secondary heat transfer loop, and adjust operation of the compressor, the pump, or both, based on the feedback and the additional feedback.

2. The HVAC system of claim 1, wherein the controller is configured to compare the first pressure and the second pressure to determine a differential pressure between the first pressure and the second pressure.

3. The HVAC system of claim 2, wherein the controller is configured to deactivate the compressor, the pump, or both, in response to a determination that the second pressure is less than the first pressure.

4. The HVAC system of claim 2, wherein the controller is configured to transmit a warning message to an electronic device in response a determination that the second pressure is less than the first pressure.

5. The HVAC system of claim 4, wherein the electronic device comprises a mobile electronic device, a thermostat, or a computer.

6. The HVAC system of claim 1, comprising a first sensor coupled to the primary heat transfer loop and configured to provide the feedback and a second sensor coupled to the secondary heat transfer loop and configured to provide the additional feedback.

7. The HVAC system of claim 1, wherein the heat exchanger is a first heat exchanger, the primary heat transfer loop comprises a second heat exchanger, and the secondary heat transfer loop comprises a third heat exchanger, wherein the second heat exchanger is configured to facilitate heat exchange between the first heat transfer fluid and a first air flow, and the third heat exchanger is configured to facilitate heat exchange between the second heat transfer fluid and a second air flow.

8. The HVAC system of claim 7, wherein the second heat exchanger is a condenser and the third heat exchanger is an evaporator.

9. The HVAC system of claim 1, wherein the first heat transfer fluid is a refrigerant and the second heat transfer fluid is different than the first heat transfer fluid.

10. A heating, ventilation, and air conditioning (HVAC) system, comprising:

a compressor configured to direct a first heat transfer fluid through a primary heat transfer loop;

a pump configured to direct a second heat transfer fluid through a secondary heat transfer loop;

a heat exchanger fluidly coupled to the primary heat transfer loop and the secondary heat transfer loop, wherein the heat exchanger is configured to receive a flow of the first heat transfer fluid at a first operating pressure and a flow of the second heat transfer fluid at a second operating pressure higher than the first operating pressure; and a controller configured to:

receive first feedback indicative of a first pressure of the first heat transfer fluid in the primary heat transfer loop and second feedback indicative of a second pressure of the second heat transfer fluid in the secondary heat transfer loop; and adjust operation of the compressor, the pump, or both, based on the first feedback and the second feedback.

11. The HVAC system of claim 10, comprising a first sensor coupled to the primary heat transfer loop and a second sensor coupled to the secondary heat transfer loop, wherein the first sensor is configured to generate a first signal indicative of the first pressure, the second sensor is configured to generate a second signal indicative of the second pressure, the first feedback comprises the first signal, and the second feedback comprises the second signal.

12. The HVAC system of claim 10, wherein the controller is configured to suspend operation of the compressor, the pump, or both, in response to a determination that the second pressure is less than the first pressure.

13. The HVAC system of claim 10, wherein the controller is configured to transmit a message to an electronic device in response to a determination that the second pressure is less than the first pressure, wherein the message comprises a request to confirm shut down of the compressor, the pump, or both.

14. The HVAC system of claim 10, wherein the primary heat transfer loop comprises an expansion device fluidly coupled between the compressor and the heat exchanger, and wherein the secondary heat transfer loop excludes an expansion device.

15. A heating, ventilation, and air conditioning (HVAC) system, comprising:

a heat exchanger configured to receive a first heat transfer fluid from a primary heat transfer loop and to receive a second heat transfer fluid from a secondary heat transfer loop;

a first sensor configured to provide feedback indicative of a first pressure of a first heat transfer fluid in the primary heat transfer loop;

a second sensor configured to provide additional feedback indicative of a second pressure of a second heat transfer fluid in the secondary heat transfer loop; and a controller configured to receive the feedback and the additional feedback and to send instructions to adjust operation of a compressor of the primary heat transfer loop based on a comparison between the feedback and the additional feedback.

16. The HVAC system of claim 15, wherein the controller is configured to send the instructions to deactivate the compressor, a pump of the secondary heat transfer loop, or both, in response to a determination that the second pressure is less than the first pressure.

17. The HVAC system of claim 15, comprising the primary heat transfer loop and the secondary heat transfer loop, wherein the first heat transfer fluid in the primary heat transfer loop is different than the second heat transfer fluid in the secondary heat transfer loop.

18. The HVAC system of claim 17, wherein the heat exchanger is a first heat exchanger, the primary heat transfer loop comprises a second heat exchanger, and the secondary heat transfer loop comprises a third heat exchanger, wherein the second heat exchanger is configured to facilitate heat exchange between the first heat transfer fluid and a first air flow, and the third heat exchanger is configured to facilitate heat exchange between the second heat transfer fluid and a second air flow.

19. The HVAC system of claim 15, wherein the controller is configured transmit a warning message to an electronic device in response to a determination that the second pressure of the second heat transfer fluid is less than the first pressure of the first heat transfer fluid.

20. The HVAC system of claim 15, wherein the primary heat transfer loop is configured to provide the first heat transfer fluid to the heat exchanger at a first operating pressure, and wherein the second heat transfer loop is configured to provide the second heat transfer fluid to the heat exchanger at a second operating pressure higher than the first operating pressure.

* * * * *